United States Patent [19]

Pavenick

[11] 4,136,801

[45] Jan. 30, 1979

[54] REPLACEABLE CARTRIDGE FOR A DISPENSER

[76] Inventor: Stanford Pavenick, 341 Scotland Rd., South Orange, N.J. 07079

[21] Appl. No.: 859,153

[22] Filed: Dec. 9, 1977

[51] Int. Cl.[2] ..... B65D 35/30; B65D 35/56

[52] U.S. Cl. ..... 222/82; 222/88; 222/95; 222/105; 222/326; 222/541

[58] Field of Search ..... 222/326, 327, 325, 390, 222/386.5, 95, 386, 94, 105, 82, 88, 541, 391

[56] References Cited

U.S. PATENT DOCUMENTS

| | | | |
|---|---|---|---|
| 2,421,711 | 6/1947 | Moots et al. | 222/327 X |
| 3,007,611 | 11/1961 | Coolidge | 222/327 X |
| 3,421,662 | 1/1969 | Hanson | 222/541 X |
| 3,624,793 | 11/1971 | Marand | 222/95 |
| 3,722,750 | 3/1973 | Fox | 222/94 |
| 3,813,534 | 5/1974 | Gilliam | 222/94 X |
| 3,993,226 | 11/1976 | Pavenick | 222/327 |
| 4,074,833 | 2/1978 | Otto | 222/390 |

*Primary Examiner*—John P. Shannon
*Attorney, Agent, or Firm*—Kirschstein, Kirschstein, Ottinger & Cobrin

[57] ABSTRACT

A replaceable cartridge for a dispenser comprises an elongated collapsible envelope for containing the material to be dispensed. The cartridge includes a tubular body portion and two end walls which are of one-piece with the tubular body portion. The cartridge is constituted by a thin-walled, flexible, limp and collapsible material. A cap portion having a discharge outlet faces one end wall of the cartridge, and a movable compression disc faces the other end wall of the cartridge. In response to movement of the disc, the cartridge is collapsed to thereby cause rupture of the end wall adjacent the discharge outlet. Alternatively, a puncture needle is provided on the cap portion for puncturing the end wall adjacent the discharge outlet. Once opened, the material within the cartridge is free to escape through the discharge outlet in response to such movement of the disc.

12 Claims, 5 Drawing Figures

1
2
3
4
5
6
7
8
9
10
11
21
30
31
32
34
35

REPLACEABLE CARTRIDGE FOR A DISPENSER

BACKGROUND OF THE INVENTION

1. Field of the Invention

The present invention generally relates to a replaceable cartridge for use in a dispenser and, more particularly, to a cartridge adapted to be easily opened to thereby permit reliable and efficient dispensing of the material contained in the cartridge.

2. Prior Art

It has been proposed in the prior art to hold a loose flowable mass of material to be dispensed in a container of a dispenser. In order to expel the material from the container, an expelling or compression force is exerted on a portion of the mass by an arrangement which is operative for moving a compression disc against the mass.

Although such prior art dispensers are generally adequate for their intended purposes they have not proven themselves to be altogether satisfactory for the following reasons:

First of all, the loose flowable mass has a slight tendency to seep through the clearance bounded by the exterior periphery of the compression disc and the inner circumferential wall of the container in which the disc is mounted. Such seepage, although slight, is undesirable because it represents not only a loss in the total amount of material to be dispensed, but also tends to slightly retard the movement of the disc lengthwise along the container. Secondly, the same dispenser cannot efficiently be used with different types of materials. Once one type of material has been held in the container, residual amounts of this material still remain on the inner circumferential wall thereof. This unsanitary environment requires an expensive sterilizing procedure should one wish to refill the container, particularly in cases wherein a different type of material is desired to charge the container. In practice, after full discharge has been completed, a user generally throws away the entire container and, in certain circumstances, the entire dispenser is discarded.

An improved dispenser which overcomes the aforementioned drawbacks of the prior art has been proposed and described in my patent U.S. Pat. No. 3,993,226 which discloses an arrangement in which the problems of mass seepage, retardation of the movement of the disc, and expensive sterilizing procedures have been substantially reduced.

SUMMARY OF THE INVENTION

1. Purposes of the Invention

It is an object of the present invention to overcome the drawbacks of the prior art dispensers.

Another object of the present invention is to prevent undesirable seepage past the compression disc of the prior art dispensers.

Still another object of the present invention is to prevent retardation of the movement of the compression disc of the prior art dispensers.

Yet another object of the present invention is to permit a single dispenser to be reused many times with the same or with different types of materials to be dispensed.

A further object of the present invention is to avoid expensive sterlizing procedures.

A still further object of the present invention is to prevent discarding of the container and/or of the entire dispenser.

An additional object of the present invention is to provide a replaceable cartridge for use in such dispensers.

A further object of the present invention is to easily and reliably open such cartidges.

Still an additional object of the present invention is to provide a cartridge of simple and economical manufacture.

2. Brief Description of the Invention

In keeping with these objects and others which will become apparent hereinafter, one feature of the invention resides, briefly stated, in a cartridge which is replaceably mounted in a dispenser. The dispenser comprises an elongated container having a discharge outlet at one end of the container, and means for expelling material to be dispensed through the discharge outlet. The expelling means includes a shaft which extends from the other end of the container towards the one end of the latter, a compression element or disc which is mounted on the shaft for movement lengthwise of the latter, and means for moving the disc from the other end toward the one end of the container.

In accordance with the invention, the replaceable cartridge comprises an elongated collapsible envelope which contains the material to be dispensed. The envelopes surrounds the shaft and is located in the container intermediate the discharge outlet and the compression element. The envelope has an openable portion adjacent the discharge outlet to thereby permit escape through the latter of the material contained in the envelope in response to collapse of the latter upon movement of the compression element towards the one end of the container. The envelope has a generally tubular body portion which has a longitudinal axis of symmetry, and two end wall portions each at a respective end of the envelope. The body portion is integral with each of the end wall portions and bounds a generally tubular passage which extends lengthwise of the axis intermediate the end wall portions. The envelope is constituted by a thin-walled, flexible, and limp material, preferably transparent synthetic plastic film material.

The envelope may be opened by providing a plurality of rupturable zones such as score lines on the envelope. These zones burst in response to internal pressure caused by movement of the disc. The envelope may also be opened by a puncture needle on the container. This needle is operative for puncturing through the end wall of the cartridge which lies adjacent to the discharge outlet.

The feature of containing the flowable mass of material within a replaceable cartridge overcomes the drawbacks noted above in the prior art. By containing the flowable material within an envelope, undesirable seepage past the compression disc as well as retardation of the movement of the latter is reliably prevented. In addition, the inner circumferential wall of the container is kept clean and sanitary. Consequently, expensive sterilization procedures are not necessary and other types of materials can subsequently be employed to charge the dispenser. The replaceability feature permits a single dispenser to be reused many times.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3:
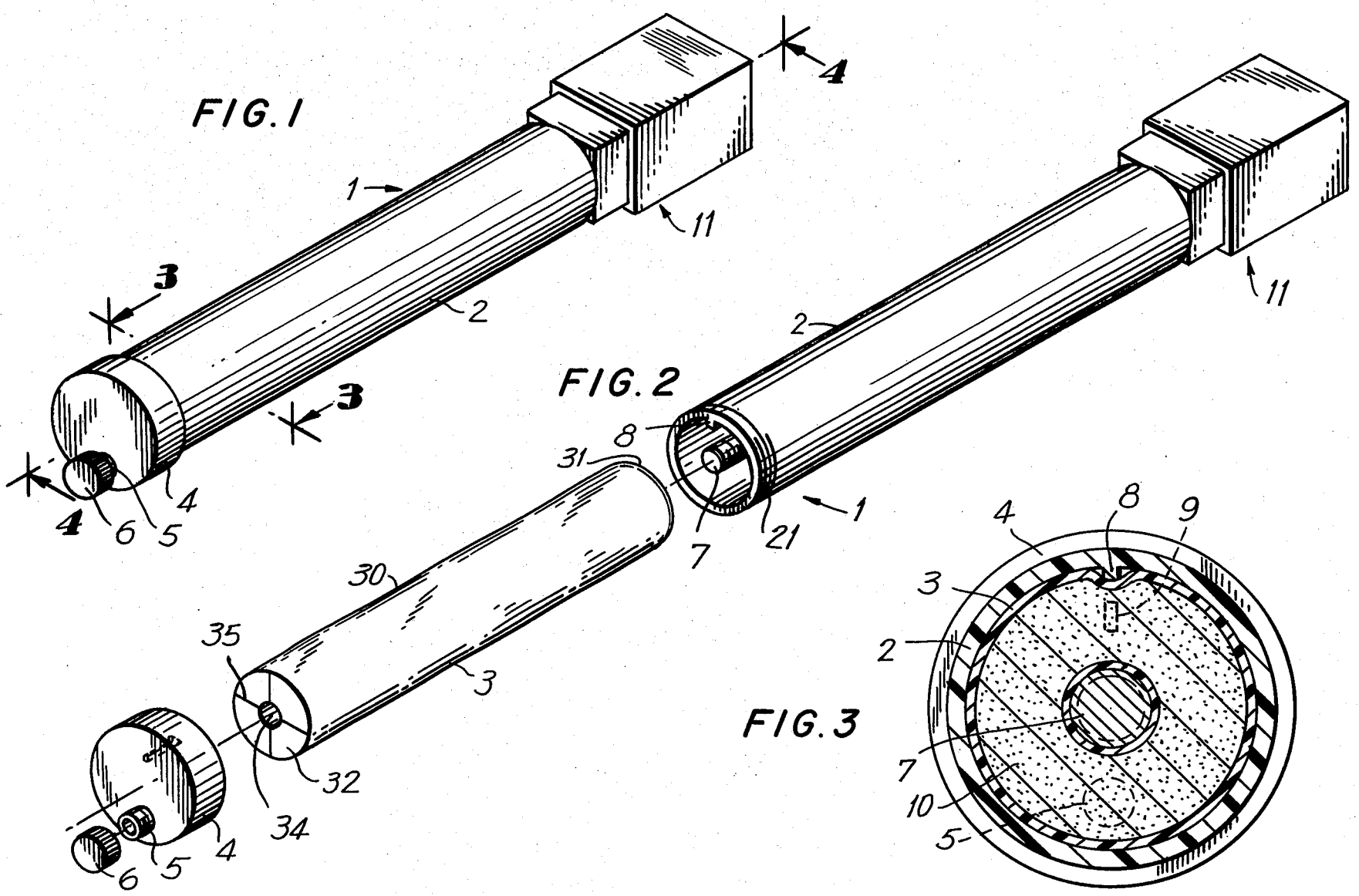
FIG. 1 is a perspective view of an assembled dispenser in accordance with the present invention.
FIG. 2 is an exploded perspective view of the dispenser of FIG. 1 in unassembled condition.
FIG. 3 is a sectional view taken on line 3—3 of FIG. 1.

FIGS. 1 and 2 respectively show an assembled and unassembled dispenser generally identified by reference numeral 1. According to this preferred embodiment of the invention, the dispenser 1 includes an elongated container or hollow tubular portion 2 for holding a replaceable envelope or cartridge 3. As shown in FIG. 3, the material 10 to be dispensed is contained within cartridge 3. The material 10 is preferably an extrudable, semi-fluid, paste-like, flowable material such as ointments, cremes, jellies, mustard, ketchup, mayonnaise, toothpaste and adhesives.

A cap portion 4 is detachably mounted at one end of tubular portion 2. As shown more clearly in FIG. 4, the cap portion 4 has an interior threaded section 20 which matingly engages a cooperating exterior threaded section 21 provided at said one end of tubular portion 2. Other types of detachable interengagement are of course possible. It will be appreciated by those skilled in this art that the cap portion 4 may be forced over said one end of tubular portion 2 and frictionally secured thereat.

Discharge outlet 5 is provided on cap portion 4; and closure member or cap 6 is removably mounted on discharge outlet or nozzle 5. Cap 6 has an interior threaded section 22 which matingly engages a cooperating exterior threaded section 23 provided on outlet 5. While the cap 6 is illustrated as being threadedly secured to outlet 5, the cap 6 may be releasably secured to outlet 5 in other ways, i.e., the cap 6 may be frictionally secured to the outlet 5 by a projection which is received within the interior passage 24 of outlet 5. The cap 6 seals the outlet 5 and serves not only to prevent contamination of the material 10 during periods of non-use of the container, but also serves to prevent drying out or hardening of the material 10 due to air contact, as well as serving to prevent unauthorized escape or oozing of the material 10 through outlet 5 during periods of nonuse.

Means are provided for expelling material 10 from the cartridge 3 through passage 24 of outlet 5. The expelling means includes a threaded shaft 7 which extends lengthwise of the tubular portion 2 intermediate the opposite ends of the latter, a compression element or annular disc 12 which is threadedly mounted on shaft 7 for movement lengthwise of the latter, and means 11 for moving disc 12 from the end of tubular portion 2 which is remote from cap portion 4 towards the end of tublar portion 2 which is adjacent to cap portion 4.

Shaft 7 is located substantially centrally within tubular portion 2 and is journalled for rotation about its axis of elongation at bearing cup 13 which is integrally formed with cap portion 4 and is also journalled at end wall 14 of tubular portion 2. Moving means 11 causes disc 12 to move along shaft 7 by rotating shaft 7. This is accomplished by mounting disc 12 in nonrotatable relationship with tubular portion 2. In this way, when shaft 7 is rotated by moving means 11 in the circumferential direction as shown by the arrow B in FIG. 5, the disc 12 is moved longitudinally along shaft 7 because disc 12 is prevented from rotating with shaft 7 due to interference with the inner circumferential wall of tubular portion 2.

Rotation of disc 12 relative to tubular portion 2 is prevented by providing a rib 8 which extends lengthwise of tubular portion 2 and which projects from the inner circumferential wall of the latter. An axial groove 15 is provided at the periphery of disc 12 and is configurated to receive the rib in sliding relationship. This spline-type arrangement permits longitudinal movement of disc 12 along shaft 7, but effectively prevents rotation of disc 12 with shaft 7.

This spline-type connection is useful in the illustrated embodiment wherein tubular portion 2 has a generally circular transverse cross-sectional configuration and wherein disc 12 has a corresponding circular configuration. However, it will be appreciated by those skilled in this art that tubular portion 2 may be provided with a square, rectangular, polygon, oblong, oval or like non-circular transverse cross-sectional configuration. If the disc is provided with such a corresonding non-circular configuration, then rotation between a respective disc and a tubular portion will cause mutual interference between the exterior circumferential wall of the disc and the interior circumferential wall of the tubular portion, and thereby prevent any relative rotation.

Moving means 11 includes an actuating button 16 having an open-ended portion 17 of rectangular cross-sectional configuration which is adapted to be slidably received on end portion 18 which is likewise of rectangular cross-sectional configuration. Due to this non-circular configuration of both the open-ended portion 17 and the end portion 18, relative longitudinal motion is permitted between these portions, but relative rotational motion is precluded.

Button 16 has a thrust wall 19 which has a centrally disposed opening through which helical portion 25 passes. Washer 26 has a centrally disposed square opening which matches the cross-section of the helical portion 25. Washer 26 is provided with teeth which are adapted to mesh with mating teeth on thrust wall 19 when the washer 26 is turned in one circumferential direction but not in the opposite circumferential direction. Such teeth on the washer 26 and on the thrust wall 19 are entirely conventional and have been described in column 7, lines 12–28, of my aforementioned U.S. patent and have been illustrated in FIGS. 6 and 7 of said U.S. patent. Coil spring 27 is held under compression between flange 28 and washer 26 and is operative to urge the latter against thrust wall 19. Shaft 7 is prevented from longitudinal displacement by the cooperation of flange 29 and flange 28 which are located on opposite sides of end wall 14.

Figure 4:
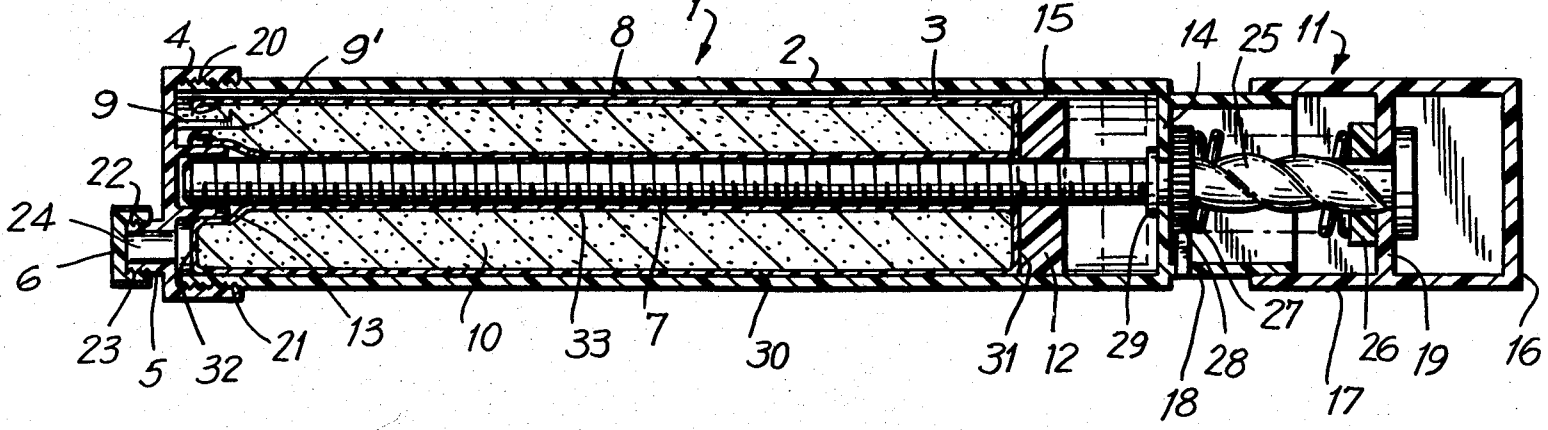
FIG. 4 is a sectional view taken on line 4—4 of FIG. 1 prior to expulsion of material to be dispensed.
Figure 5:
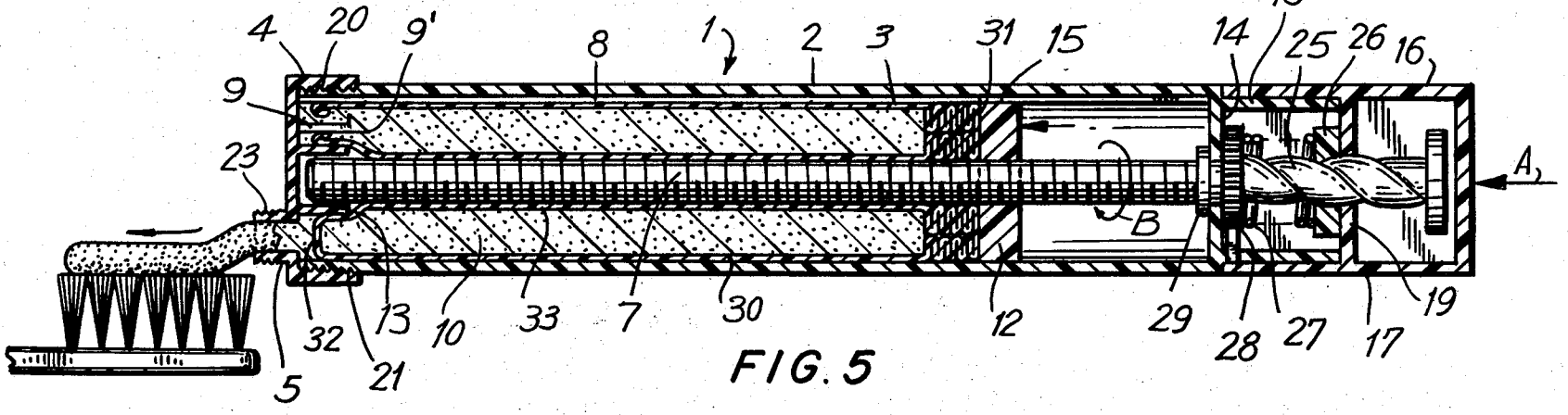
FIG. 5 is a sectional view analogous to FIG. 4 during expulsion of material to be dispensed.

When button 16 is pushed from its position in FIG. 4 to its illustrated position in FIG. 5, the washer 26 is shifted along helical portion 25. The interaction of the square opening in washer 26 with the helical portion 25 applies a rotational force to the washer 26 which causes interengagement of the teeth on washer 26 with the teeth on thrust wall 19. This interengagement prevents washer 26 from rotating. Consequently, the helical portion 25, which is connected to shaft 7, is caused to rotate. The number of degrees that the shaft 7 will rotate depends upon the twist and the length of the helix and the extent to which the button 16 is pushed. This kinematic connection between the teeth on washer 26 and on thrust wall 19 to the shaft 7 is entirely conventional and has been described beginning at column 7, line 57, and ending at column 8, line 8, of my aforesaid patent.

Those skilled in this art will appreciate that the kinematic translating means which is operative to rotate the shaft 7 is conventional and has been described in my previous patent, U.S. Pat. No. 3,993,266; the entire contents of which, and particularly the above-identified portions thereof, being hereby incorporated by reference. As noted above, as shaft 7 is rotated, the disc 12 will move longitudinally along shaft 7 and exert a compression force on the cartridge 3 in order to urge material 10 towards outlet 5.

In accordance with the invention, the cartridge 3 is elongated and comprises a generally tubular body portion 30 and two end wall portions 31 and 32. The tubular body portion 30 and the end wall portions 31, 32 are all integral with each other and are all constituted by a relatively thin-walled, flexible, limp and collapsible material such as a synthetic plastic material film. The film may be transparent in which case the tubular portion 2 is also constituted by transparent material so that a user will have a visual indication of how much material 10 is present in the cartridge 3.

The cartridge 3 is illustrated as having a generally circular cross-sectional configuration; however, it will be appreciated that other non-circular configurations are also within the spirit of the present invention.

The cartridge is provided with wall portions 33 which bound a tubular passage 34 through which shaft 7 passes with slight clearance. This feature facilitates easy replacement of a spent cartridge with a fresh one. Preferably, passage 34 has a generally circular cross-sectional configuration and extends intermediate end walls 31 and 32.

The cartridge 3 is disposed within tubular portion 2 with end wall 32 facing the outlet 5 and with end wall 31 facing the disc 12. A portion of end wall 32 is made openable so as to permit escape of the material 10 towards the outlet 5. Thus, end wall 32 is provided with a plurality of rupturable zones 35, i.e. score lines (see FIG. 2). In response to movement of disc 12 towards cap portion 4, the internal pressure within cartridge 3 will increase until the material 10 bursts through the ruptured zones 35. Alternatively, the cap portion 4 is provided with a puncture needle as best illustrated in FIGS. 4 and 5. Needle 9 is of one-piece with cap portion 4 and has a sharpened tip 9′ operative for puncturing a portion of end wall 32.

No matter whether the needle 9 and/or the rupturable zones 35 are used to open the cartridge 3, the material 10 flows out of the cartridge 3 in direction towards outlet 5. Each time the button 16 is pushed in direction of the arrow A of FIG. 5, a metered amount of material 10 is expelled through passage 24. As illustrated, the material 10 is forced out of nozzle 5 as a circular column onto a toothbrush.

It will be understood that each of the elements described above, or two or more together, may also find a useful application in other types of constructions differing from the types described above.

While the invention has been illustrated and described as embodied in a replaceable cartridge for a dispenser it is not intended to be limited to the details shown, since various modifications and structural changes may be made without departing in any way from the spirit of the present invention.

With further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a dispenser, a combination comprising:
   a. an elongated container having a discharge outlet at one end of said container;
   b. means for expelling material to be dispensed through said discharge outlet, including
      a shaft extending from the other end of said container towards said one end of the latter,
      a compression element mounted on said shaft for movement lengthwise of the latter, and means for moving said compression element from said other end towards said one end of said container; and
   c. a replaceable collapsible envelope for containing the material to be dispensed, said envelope surrounding said shaft and being located in said container intermediate said discharge outlet and said compression element, said envelope having an openable portion adjacent said discharge outlet to thereby permit escape through the latter of the material contained in said envelope in response to collapse of the latter upon movement of said compression element towards said one end of said container.

2. The combination of claim 1, wherein said container includes a tubular portion and a cap portion mounted on said tubular portion, and wherein said discharge outlet is provided on said cap portion.

3. The combination of claim 2, wherein said tubular portion has a thread, and wherein said cap portion has a mating thread for threadedly engaging the thread of said tubular portion.

4. The combination of claim 2, wherein said cap portion has an axis of symmetry, and wherein said discharge outlet on said cap portion is offset from said axis.

5. The combination of claim 1; and further comprising a closure member mountable on said discharge outlet for closing the latter.

6. The combination of claim 1, wherein said shaft has a turnable end region; and wherein said container includes a cap portion having means for journalling said turnable end region of said shaft.

7. The combination of claim 1, wherein said moving means is operatively connected to said shaft for rotating the latter, and wherein said compression element engages said shaft for rotation with the latter and also engages said container in non-rotatable relationship with the latter to thereby permit longitudinal displacement of said compression element along said shaft.

8. The combination of claim 1, wherein said collapsible envelope is a thin-walled, flexible, limp casing constituted by synthetic plastic material.

9. The combination of claim 1, wherein said collapsible envelope is tubular and has wall portions bounding an elongated passage in which said shaft is received, said envelope having an end wall portion at each end of said passage.

10. The combination of claim 1, wherein said openable portion includes a plurality of rupturable zones on said envelope for bursting the latter in response to said movement of said compression element.

11. The combination of claim 1; and further comprising means for opening said openable portion of said envelope, said opening means including a puncture needle on said container for puncturing said openable portion.

12. The combination of claim 11, wherein said container includes a tubular portion and a cap portion mountable on said tubular portion and wherein said needle is provided on said cap portion and is operative for puncturing said openable portion when said cap portion is mounted on said tubular portion.

* * * * *